US006935912B1

(12) United States Patent
Myers

(10) Patent No.: US 6,935,912 B1
(45) Date of Patent: Aug. 30, 2005

(54) SELF-CONTAINED, EMERGENCY MARKER FOR ATTACHING TO, AND SELECTIVELY ASCENDING FROM, A DIVER'S BUOYANCY CONTROL DEVICE

(76) Inventor: A. Reid Myers, 3118 Melrose Ct., Anderson, IN (US) 46011

( * ) Notice: Subject to any disclaimer, the term of this patent is extended or adjusted under 35 U.S.C. 154(b) by 84 days.

(21) Appl. No.: 10/818,295

(22) Filed: Apr. 5, 2004

(51) Int. Cl.[7] ..... B63C 9/20
(52) U.S. Cl. ..... 441/89; 114/315; 116/210
(58) Field of Search ..... 441/6, 7, 11–13, 441/80, 89, 94; 114/315; 116/210; 405/185, 186

(56) References Cited

U.S. PATENT DOCUMENTS

| | | | | | |
|---|---|---|---|---|---|
| 2,825,803 | A | * | 3/1958 | Newbrough | 455/96 |
| 3,907,236 | A | | 9/1975 | Sims, Jr. | |
| 4,114,561 | A | * | 9/1978 | Asaro | 116/210 |
| 4,295,438 | A | * | 10/1981 | Porter | 116/210 |
| 4,443,203 | A | | 4/1984 | Maertens | |
| 4,551,106 | A | * | 11/1985 | Prager | 441/94 |
| 5,141,458 | A | | 8/1992 | Church | |
| 5,326,297 | A | * | 7/1994 | Loughlin | 441/89 |
| 5,516,316 | A | | 5/1996 | Rumminger | |
| 5,520,486 | A | * | 5/1996 | Van Wyck | 405/186 |
| 5,791,956 | A | * | 8/1998 | Smith | 441/6 |
| 6,273,773 | B1 | | 8/2001 | Bourke | |
| 2002/0140599 | A1 | | 10/2002 | King | |

* cited by examiner

*Primary Examiner*—Andrew D. Wright
(74) *Attorney, Agent, or Firm*—Richard L. Miller

(57) ABSTRACT

A self-contained, emergency marker for attaching to, and selectively ascending from, a scuba diver's buoyancy control device. A buoy portion is contained in an enclosure and is selectively released therefrom by an activating apparatus. A buoy inflates, escapes from a buoy sub-enclosure by buoyancy, and tethers a buoy cord out of a buoy cord sub-enclosure when a pull pin is released, causing an upper end of an arm to bias away from the buoy sub-enclosure, causing a lower end of the arm to pivot toward the buoy sub-enclosure, causing a pin to rise and puncture a $CO_2$ cartridge. The buoy has thereon a beeper and a flashing strobe light that electrically communicate with a battery interface that, in one embodiment is located in the buoy, and in another embodiment is located in the buoy cord sub-enclosure.

15 Claims, 3 Drawing Sheets

SELF-CONTAINED, EMERGENCY MARKER FOR ATTACHING TO, AND SELECTIVELY ASCENDING FROM, A DIVER'S BUOYANCY CONTROL DEVICE

BACKGROUND OF THE INVENTION

1. Field of the Invention

The present invention relates to a self-contained, emergency marker. More particularly, the present invention relates to a self-contained, emergency marker for attaching to, and selectively ascending from, a scuba diver's buoyancy control device.

2. Description of the Prior Art

Numerous innovations for diver markers have been provided in the prior art that will be described. Even though these innovations may be suitable for the specific individual purposes to which they address, however, they differ from the present invention.

A FIRST EXAMPLE, U.S. Pat. No. 3,907,236 to Sims, Jr. teaches an elongated life line reel used by a scuba diver to contain a length of line secured at one end to the reel and at the other end to a float so that at all times the diver's presence is known. As the diver descends the line is unwound or removed from the reel which is secured about his arm or leg by means of a pair of flexible straps respectively attached to the reel by a pair of spring members. The elongated shape of the reel allows the reel to fit securely on the forearm or leg of the diver, contains a long length of line and allows unrestricted movement of the diver in the water. The spring members function is to permit easy attaching of the reel to the arm or leg and will operate to maintain the reel about the arm or leg at the different underwater pressures encountered by the diver.

A SECOND EXAMPLE, U.S. Pat. No. 4,443,203 to Maertens teaches a marker buoy to positively mark positions on a water surface with respect to the bottom. The marker includes a generally hollow body with a line wound around the approximate center thereof with a weight on the end of the line which will cause the marker to rotate when the marker is placed or thrown onto the water surface to cause the line to unwind from the marker. A line stop flange is provided on the marker to stop unwinding of the line when the weight strikes the bottom. This flange comes into effect when water partially fills the marker which will cause the marker to shift from a position of lying on the water surface to being erect within the water. When the marker is in the upright or erect position, the line is engaged by the line stop flange. When the marker is in this erect or upright position, one end will be above the surface of the water and therefore easily visible.

A THIRD EXAMPLE, U.S. Pat. No. 5,141,458 to Church teaches a marker buoy, typically for use by dives, that includes a lighter-than-water flotation component, such as a bladder which can be inflated when the buoy is required to float and deflated when it is not required to float, so that the diver can easily dive with the deflated buoy and inflate it at depth, when required. A reel of line carried by the buoy is arranged to dispense the line therefrom when the tension in the line exceeds a chosen value.

A FOURTH EXAMPLE, U.S. Pat. No. 5,516,316 to Rumminger teaches a diver awareness buoy for signaling the presence of scuba divers diving underwater within a general diving area including a base and an inflatable bladder having a main body. The main body has a humanoid configuration including a torso section and a head section simulating the upper body of a scuba diver present in water. The torso section includes torso indicia corresponding to the signal for signaling that a scuba diver is beneath the water surface. A ballast is carried by the inflatable bladder for maintaining the buoy in an upright floating position in water.

A FIFTH EXAMPLE, U.S. Pat. No. 6,273,773 B1 to Bourke teaches a dive buoy/dry box assembly comprising a hollow canister-like main float assembly having a hinged latchable air-tight sealing lid, a collapsible marker flat and mast removably attached to the lid, a collapsible staff and ballast weight removably attached to the bottom of the float assembly and a buoy line storage reel detachably mounted surrounding the float assembly in a horizontal plane, the marker flat, mast ballast weight and staff all storable in the float assembly when collapsed.

A SIXTH EXAMPLE, U.S. Patent Application Publication No. 2002/0140599 A1 to King teaches a scuba diving flag/float assembly that is used to support a GPS antenna on the surface of the water for use by divers in performing underwater navigation. An associated GPS receiver is integrated with a dive flag line take-up mechanism such as a spool or SCUBA diving line reel. The dive flag line and cable interconnecting the GPS receiver to the GPS antenna is integrated within a single assembly, or in an alternate embodiment, braided together forming a single tether. Alternate embodiments include optional sensors such as a flowmeter, compass, tiltmeter, depth gauge and diver techniques to compensate for navigational errors due to a water current pushing a dive flag/float away from a diver. Alternatively, a GPS receiver may be mounted on or in the dive flag/float assembly and navigational information relayed to the diver under the water.

It is apparent that numerous innovations for diver markers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a self-contained, emergency marker for attaching to, and selectively ascending from, a scuba diver's buoyancy control device that avoids the disadvantages of the prior art.

ANOTHER OBJECT of the present invention is to provide a self-contained, emergency marker for attaching to, and selectively ascending from, a scuba diver's buoyancy control device that is simple to use.

BRIEFLY STATED, STILL ANOTHER OBJECT of the present invention is to provide a self-contained, emergency marker for attaching to, and selectively ascending from, a scuba diver's buoyancy control device. A buoy portion is contained in an enclosure and is selectively released therefrom by an activating apparatus. A buoy inflates, escapes from a buoy sub-enclosure by buoyancy, and tethers a buoy cord out of a buoy cord sub-enclosure when a pull pin is released, causing an upper end of an arm to bias away from the buoy sub-enclosure, causing a lower end of the arm to pivot toward the buoy sub-enclosure, causing a pin to rise and puncture a $CO_2$ cartridge. The buoy has thereon a beeper and a flashing strobe light that electrically communicates with a battery interface that, in one embodiment is located in the buoy, and in another embodiment is located in the buoy cord sub-enclosure.

The novel features which are considered characteristic of the present invention are set forth in the appended claims. The invention itself, however, both as to its construction and its method of operation, together with additional objects and advantages thereof, will be-best understood from the following description of the specific embodiments when read and understood in connection with the accompanying drawing.

BRIEF DESCRIPTION OF THE DRAWING

The figures of the drawing are briefly described as follows.

Figure 1:
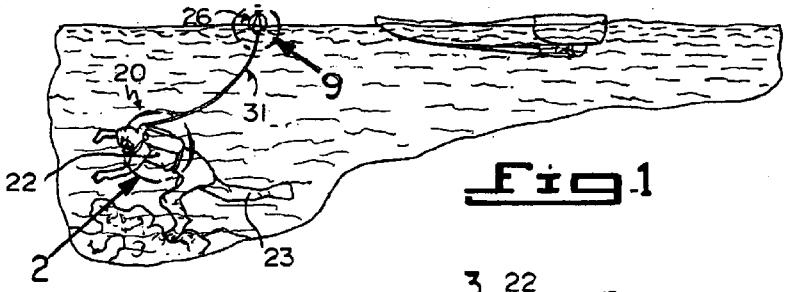
FIG. 1 is a diagrammatic perspective view of the present invention in use.

List of Reference Numerals Utilized in the Drawing

20 self-contained, emergency marker of present invention for attaching to, and selectively ascending from, scuba diver's buoyancy control device 22
22 scuba diver's buoyancy control device
23 scuba diver
24 enclosure
26 buoy portion
28 activating apparatus
29 buoy of buoy portion 26
30 buoy sub-enclosure of enclosure 24 for lying flat against scuba diver's buoyancy control device 22
31 buoy cord of buoy portion 26
32 buoy cord sub-enclosure of enclosure 24 for lying flat against scuba diver's buoyancy control device 22
34 arm of activating apparatus 28
36 pivot of activating apparatus 28
38 upper end of arm 34 of activating apparatus 28
39 lower end of arm 34 of activating apparatus 28
40 spring of activating apparatus 28
42 pin of lower end 39 of arm 34 of activating apparatus 28
44 pull pin of activating apparatus 28
46 $CO_2$ cartridge of activating apparatus 28
48 head of buoy 29 of buoy portion 26
50 neck of buoy 29 of buoy portion 26
52 beeper on head 48 of buoy 29 of buoy portion 26
54 flashing strobe light on head 48 of buoy 29 of buoy portion 26
56 battery interface contained in neck 50 of buoy 29 of buoy portion 26 for containing batteries 57 for powering beeper 52 of buoy 29 of buoy portion 26 and flashing strobe light 54 of buoy 29 of buoy portion 26
57 batteries for powering beeper 52 of buoy 29 of buoy portion 26 and flashing strobe light 54 of buoy 29 of buoy portion 26
58 33 foot colored portions 58 of buoy cord 31 of buoy portion 26 for giving rescuer (not shown) depth of diver alerting rescuer (not shown) what equipment will be necessary for rescue

Alternate Embodiment

124 enclosure
126 buoy portion
129 buoy
131 buoy cord of buoy portion 126
132 buoy cord sub-enclosure of enclosure 124
152 beeper of buoy 129 of buoy portion 126
154 flashing strobe light of buoy 129 of buoy portion 126
156 battery interface

DETAILED DESCRIPTION OF THE PREFERRED EMBODIMENT

Figure 2:
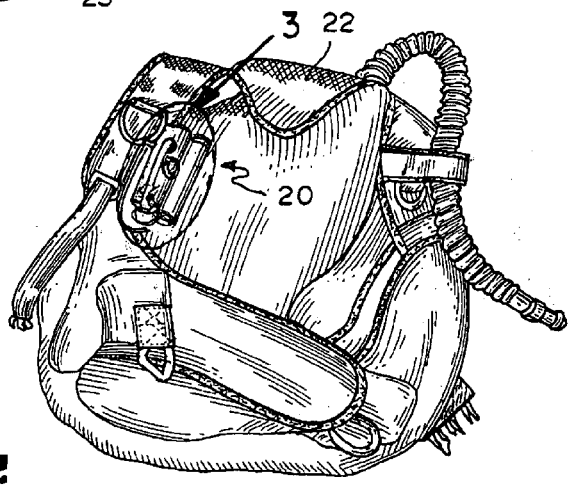
FIG. 2 is an enlarged diagrammatic perspective view of the area generally enclosed by the dotted curve identified by arrow 2 in FIG. 1 of the scuba diver's buoyancy control device having the present invention attached thereto.

Referring now to the figures, in which like numerals indicate like parts, and particularly to FIGS. 1 and 2, a self-contained, emergency marker of the present invention is shown generally at 20 for attaching to, and selectively ascending from, a scuba diver's buoyancy control device 22.

Figure 3:
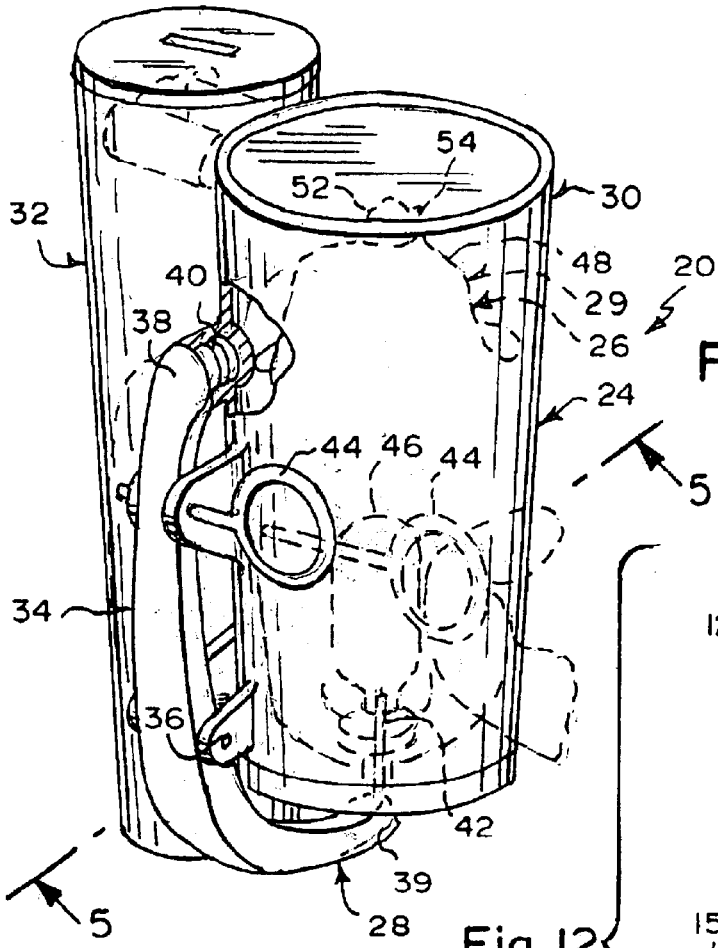
FIG. 3 is an enlarged diagrammatic perspective view of the area generally enclosed by the dotted curve identified by arrow 3 in FIG. 2 of the present invention, with parts broken away and in section.

The overall configuration of the self-contained, emergency marker can best be seen in FIGS. 3 and 4, and as such, will be discussed with reference thereto.

The self-contained, emergency marker 20 comprises an enclosure 24, a buoy portion 26, and activating apparatus 28. The buoy portion 26 is contained in the enclosure 24 and is selectively released therefrom by the activating apparatus 28.

The buoy portion 26 comprises a buoy 29 and a buoy cord 31 that is attached to the buoy 29 of the buoy portion 26.

The enclosure 24 comprises a buoy sub-enclosure 30 and a buoy cord sub-enclosure 32. The buoy sub-enclosure 30 of the enclosure 24 is attached to the buoy cord sub-enclosure 32 of the enclosure 24 and contains the buoy 29 of the buoy portion 26, while the buoy cord sub-enclosure 32 of the enclosure 24 coilingly contains the buoy cord 31 of the buoy portion 26.

Each of the buoy sub-enclosure 30 of the enclosure 24 and the buoy cord sub-enclosure 32 of the enclosure 24 is hollow and cylindrically-shaped for lying flat against the scuba diver's buoyancy control device 22.

The activating apparatus 28 comprises an arm 34. The arm 34 of the activating apparatus 28 is pivotally attached to the buoy sub-enclosure of the enclosure 24 at a pivot 36, and when activated, causes the buoy 29 of the buoy portion 26 to inflate, escape from the buoy sub-enclosure of the enclosure 24 by buoyancy, and tether the buoy cord 31 of the buoy portion 26 out of the buoy cord sub-enclosure 32 of the enclosure 24.

Figure 5:
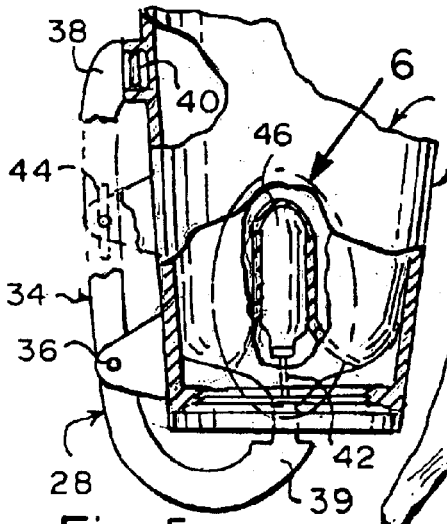
FIG. 5 is a diagrammatic partial cross sectional view, with parts broken away, taken along LINE 5—5 in FIG. 3 of the activating apparatus of the present invention.
Figure 6:
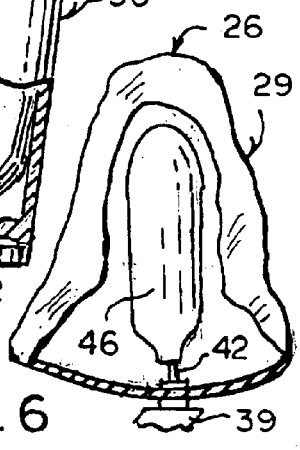
FIG. 6 is an enlarged diagrammatic side elevational view, partly in cross section, of the area generally enclosed by the dotted curve identified by arrow 6 in FIG. 5 of the inflating portion of the activating apparatus.

The specific configuration of the activating apparatus 28 can best be seen in FIGS. 3, 5 and 6, and as such, will be discussed with reference thereto.

The arm 34 of the activating apparatus 28 is generally L-shaped and has an upper end 38 and a lower end 39. The upper end 38 of the arm 34 of the activating apparatus 28 is biased away from the buoy sub-enclosure of the enclosure 24 by a spring 40, while the lower end 39 of the arm 34 of the activating apparatus 28 extends upwardly into the buoy sub-enclosure 30 of the enclosure 24 and terminates in a pin 42.

The upper end 38 of the arm 34 of the activating apparatus 28 is prevented from biasing away from the buoy sub-enclosure 30 of the enclosure 24 by a pull pin 44 that extends through the buoy sub-enclosure 30 of the enclosure 24 and the arm 34 of the activating apparatus 28, above the pivot 36.

The activating apparatus 28 further comprises a $CO_2$ cartridge 46. The $CO_2$ cartridge 46 of the activating apparatus 28 extends upwardly in the buoy sub-enclosure 30 of the enclosure 24, is affixed to the buoy 29 of the buoy portion 26, is operatively connected to the pin 42 of the activating apparatus 28, and when punctured, inflates the buoy 29 of the buoy portion 26.

Figures 4, 7, 8, 11:
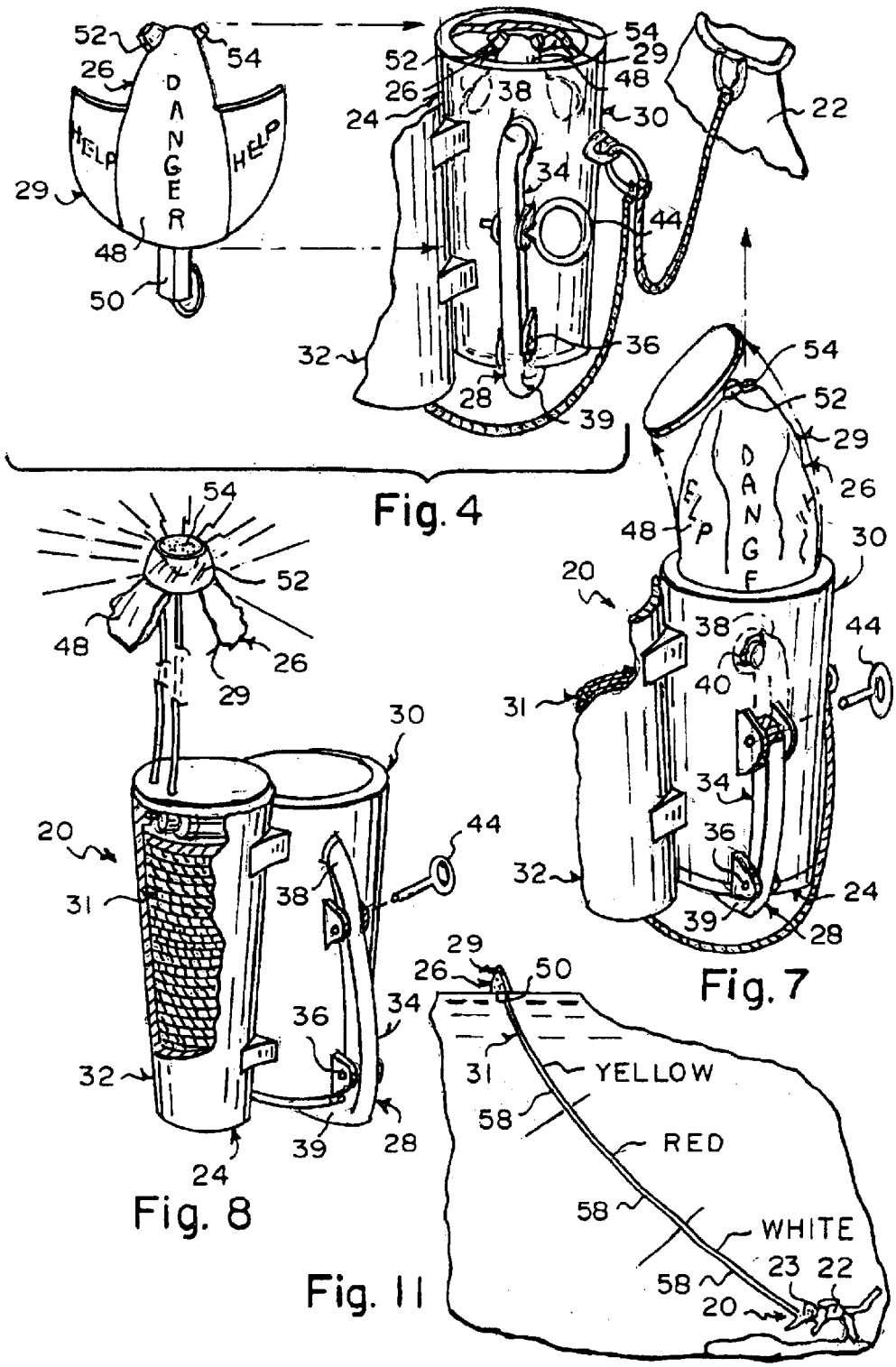
FIG. 4 is a partially exploded perspective view of the present invention shown in FIG. 3, with parts broken away and in section.
FIG. 7 is a diagrammatic perspective view of the present invention at the start of activation, with parts broken away and in section.
FIG. 8 is a diagrammatic perspective view of the present invention at the end of activation, with parts broken away and in section.
FIG. 11 is an enlarged diagrammatic perspective view showing the cord portion of the present invention in greater detail.

As shown in FIGS. 7 and 8, the buoy 29 of the buoy portion 26 inflates, escapes from the buoy sub-enclosure 30 of the enclosure 24 by buoyancy, and tethers the buoy cord 31 of the buoy portion 26 out of the buoy cord sub-enclosure 32 of the enclosure 24 when the pull pin 44 of the activating apparatus 28 is released, causing the upper end 38 of the arm 34 of the activating apparatus 26 to bias away from the buoy sub-enclosure 30 of the enclosure 24, causing the lower end 39 of the arm 34 of the activating apparatus 26 to pivot toward the buoy sub-enclosure 30 of the enclosure 24, causing the pin 42 of the activating apparatus 26 to rise and puncture the $CO_2$ cartridge 46 of the activating apparatus 28.

Figure 9:
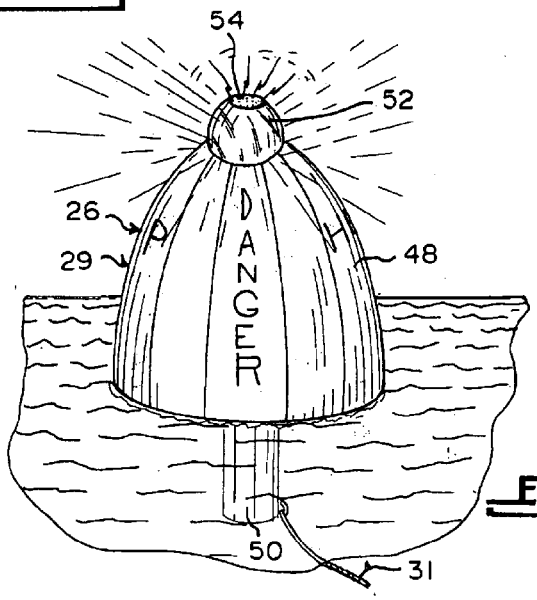
FIG. 9 is an enlarged diagrammatic perspective view of the area generally enclosed by the dotted curve identified by ARROW 9 in FIG. 1 of the buoy portion of the present invention.
Figure 10:
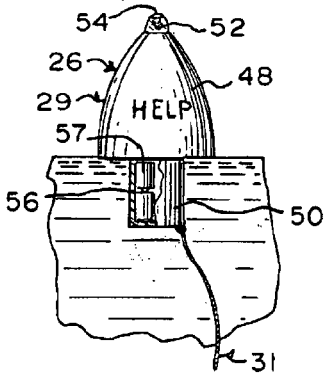
FIG. 10 is a reduced diagrammatic side elevational view in partial section of the buoy portion of the present invention shown in FIG. 9, with parts broken away and in section.

The specific configuration of the buoy 29 of the buoy portion 26 can best be seen in FIGS. 9 and 10, and as such, will be discussed with reference thereto.

The buoy 29 of the buoy portion 26 comprises a head 48 and a neck 50. The head 48 of the buoy 29 of the buoy portion 26 is inflatable, and has thereon a beeper 52 and a flashing strobe light 54. The neck 50 of the buoy 29 of the buoy portion 26 depends from the head 48 of the buoy 29 of the buoy portion 26, and contains a battery interface 56.

The battery interface 56 of the buoy portion 26 electrically communicates with the beeper 52 of the buoy 29 of the buoy portion 26 and the flashing strobe light 54 of the buoy 29 of the buoy portion 26 and is for containing batteries 57 for powering the beeper 52 of the buoy 29 of the buoy portion 26 and the flashing strobe light 54 of the buoy 29 of the buoy portion 26.

The specific configuration of the buoy cord 31 of the buoy portion 26 can best be seen in FIG. 11, and as such, will be discussed with reference thereto.

The buoy cord 31 of the buoy portion 26 depends from the neck 50 of the buoy 29 of the buoy portion 26, and is divided into 33 foot colored portions 58 of yellow, red, and white, since under water every 33 feet is equivalent to an atmosphere. The 33 foot colored portions 58 of the buoy cord 31 of the buoy portion 26 is for giving a rescuer (not shown) a depth of a diver 23 alerting the rescuer (not shown) what equipment will be necessary for a rescue.

Figure 12:
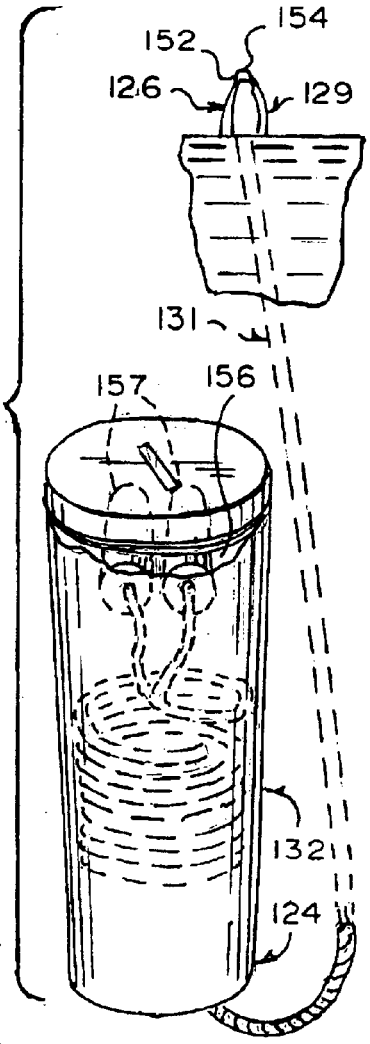
FIG. 12 is a diagrammatic perspective view of an alternate embodiment of the present invention, with parts broken away and in section.

FIG. 12 shows an alternate embodiment wherein a battery interface 156 containing batteries 157 is contained in a buoy cord sub-enclosure 132 of an enclosure 124, and electrically communicates with a beeper 152 of a buoy 129 of a buoy portion 126 and a flashing strobe light 154 of the buoy 129 of the buoy portion 126 through a buoy cord 131 of the buoy portion 126.

It will be understood that each of the elements described above, or two or more together, may also find a useful application in other types of constructions differing from the types described above.

While the invention has been illustrated and described as embodied in a self-contained, emergency marker for attaching to, and selectively ascending from, a scuba diver's buoyancy control device, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A self-contained, emergency marker for attaching to, and selectively ascending from, a scuba diver's buoyancy control device, said marker comprising:

a) an enclosure;

b) a buoy portion; and c) activating apparatus;

wherein said buoy portion is contained in said enclosure; and wherein said buoy portion is selectively released from said enclosure by said activating apparatus, wherein said buoy portion comprises a buoy;

wherein said buoy portion comprises a buoy cord; and wherein said buoy cord of said buoy portion is attached to said buoy of said buoy portion, wherein said enclosure comprises a buoy sub-enclosure;

wherein said enclosure comprises a buoy cord sub-enclosure;

wherein said buoy sub-enclosure of said enclosure is attached to said buoy cord sub-enclosure of said enclosure;

wherein said buoy sub-enclosure of said enclosure contains said buoy of said buoy portion; and wherein said buoy cord sub-enclosure of said enclosure coilingly contains said buoy cord or said buoy portion, wherein said buoy sub-enclosure of said enclosure is hollow;

wherein said buoy cord sub-enclosure of said enclosure is hollow;

wherein said buoy sub-enclosure of said enclosure is cylindrically-shaped for lying flat against the scuba diver's buoyancy control device; and wherein said buoy cord sub-enclosure of said enclosure is cylindrically-shaped for lying flat against the scuba diver's buoyancy control device.

2. The marker as defined in claim 1, wherein said activating apparatus comprises an arm;

wherein said arm of said activating apparatus is pivotally attached to said buoy sub-enclosure of said enclosure at a pivot; and wherein said buoy of said buoy portion inflates, escapes from said buoy sub-enclosure of said enclosure by buoyancy, and tethers said buoy cord of said buoy portion out of said buoy cord sub-enclosure of said enclosure when said arm of said activating apparatus is activated.

3. The marker as defined in claim 2, wherein said arm of said activating apparatus is generally L-shaped.

4. The marker as defined in claim 2, wherein said arm of said activating apparatus has an upper end;

wherein said arm of said activating apparatus has a lower end;

wherein said upper end of said arm of said activating apparatus is biased away from said buoy sub-enclosure of said enclosure by a spring;

wherein said lower end of said arm of said activating apparatus extends upwardly into said buoy sub-enclosure of said enclosure; and wherein said lower end of said arm of said activating apparatus terminates in a pin.

5. The marker as defined in claim 4, wherein said upper end of said arm of said activating apparatus is prevented from biasing away from said, buoy sub-enclosure of said enclosure by a pull pin;

wherein said pull pin of said activating apparatus extends through said buoy sub-enclosure of said enclosure;

wherein said pull pin of said activating apparatus extends through said arm of said activating apparatus; and wherein said pull pin of said activating apparatus is disposed above said pivot.

6. The marker as defined in claim 5, wherein said activating apparatus comprises a $CO_2$ cartridge;

wherein said $CO_2$ cartridge of said activating apparatus extends upwardly in said buoy sub-enclosure of said enclosure;

wherein said $CO_2$ cartridge of said activating apparatus is affixed to said buoy of said buoy portion;

a wherein said $CO_2$ cartridge of said activating apparatus is operatively connected to said pin of said activating apparatus; and wherein said $CO_2$ cartridge of said activating apparatus inflates said buoy of said buoy portion when punctured.

7. The marker as defined in claim 6, wherein said buoy of said buoy portion inflates, escapes from said buoy sub-enclosure of said enclosure by buoyancy, and tethers said buoy cord of said buoy portion out of said buoy cord sub-enclosure of said enclosure when said pull pin of said activating apparatus is released, causing said upper end of said arm of said activating apparatus to bias away from said buoy sub-enclosure of said enclosure, causing said lower end of said arm of said activating apparatus to pivot toward said buoy sub-enclosure of said enclosure, causing said pin of said activating apparatus to rise and puncture said $CO_2$ cartridge of said activating apparatus.

8. The marker as defined in claim 1, wherein said buoy of said buoy portion comprises a head;

wherein said buoy of said buoy portion comprises a neck;

wherein said head of said buoy of said buoy portion is inflatable; and wherein said neck of said buoy of said buoy portion depends from said head of said buoy of said buoy portion.

9. The marker as defined in claim 8, wherein said head of said buoy of said buoy portion has thereon a beeper.

10. The marker as defined in claim 9, wherein said head of said buoy of said buoy portion has thereon a flashing strobe light.

11. The marker as defined in claim 10, wherein said buoy cord sub-enclosure of said enclosure contains a battery interface;

wherein said battery interface electrically communicates with said beeper of said buoy of said buoy portion through said buoy cord of said buoy portion; and wherein said battery interface electrically communicates with said flashing strobe light of said buoy of said buoy portion through said buoy cord of said buoy portion.

12. The marker as defined in claim 10, wherein said neck of said buoy of said buoy portion contains a battery interface;

wherein said battery interface is for containing batteries;

wherein the batteries are for powering said beeper of said buoy of said buoy portion; and wherein the batteries are for powering said flashing strobe light of said buoy of said buoy portion.

13. The marker as defined in claim 12, wherein said battery interface of said buoy portion electrically communicates with said beeper of said buoy of said buoy portion; and wherein said battery interface of said buoy portion electrically communicates with said flashing strobe light of said buoy of said buoy portion.

14. The marker as defined in claim 8, wherein said buoy cord of said buoy portion depends from said neck of said buoy of said buoy portion.

15. The marker as defined in claim 14, wherein said buoy cord of said buoy portion is divided into 33 foot colored portions of yellow, red, and white, since under water every 33 feet is equivalent to an atmosphere; and wherein said 33 foot colored portions of said buoy cord of said buoy portion is for giving a rescuer a depth of a diver alerting the rescuer what equipment will be necessary for a rescue.

* * * * *